US005400447A

United States Patent [19]

Pokorny

[11] Patent Number: 5,400,447

[45] Date of Patent: Mar. 28, 1995

[54] FOLDING BED ASSEMBLY FOR USE WITHIN AN ARTICLE OF FURNITURE

[75] Inventor: L. Robert Pokorny, Wading River, N.Y.

[73] Assignee: Louis Pokorny Company, Inc., Ronkonkoma, N.Y.

[21] Appl. No.: 169,366

[22] Filed: Dec. 20, 1993

[51] Int. Cl.[6] ..... A47C 17/58

[52] U.S. Cl. ..... 5/2.1; 5/6; 5/138; 5/155; 5/159.1; 5/160

[58] Field of Search ..... 5/2.1, 4, 6, 7, 137, 5/138, 149, 155, 159.1, 160, 170

[56] References Cited

U.S. PATENT DOCUMENTS

| | | | |
|---|---|---|---|
| 1,814,828 | 7/1931 | Chakes et al. | 5/155 |
| 2,313,813 | 3/1943 | Ebhert | 5/159.1 X |
| 3,475,769 | 11/1969 | Fasanella | 5/7 X |
| 3,852,837 | 12/1974 | Eakins | 5/155 |

FOREIGN PATENT DOCUMENTS

| | | | |
|---|---|---|---|
| 1557026 | 2/1969 | France | 5/155 |
| 2127683 | 4/1984 | United Kingdom | 5/149 |

*Primary Examiner*—Michael F. Trettel
*Attorney, Agent, or Firm*—Levine & Mandelbaum

[57] ABSTRACT

A folding bed assembly for use within an article of furniture, such as a desk, having a fixed top wall. A series of bed sections, pivoted to one another in succession, are foldable into a generally rectangular collapsed condition in which the longer dimension of the rectangle is oriented vertically when the folded sections are within the article of furniture. The bed sections are mounted on a wheeled carriage, and a vertical panel hides the bed assembly when it is within the article of furniture. A carriage linkage responds to pivoting of the panel from its vertical orientation to a horizontal orientation for moving the carriage and bed sections out of the article of furniture. A swing-out linkage pivotally supports the collapsed bed sections on the carriage, the swing-out linkage constraining the collapsed bed sections to move between a storage position, in which the collapsed bed sections are close to the carriage, and a swing-out position in which the collapsed bed sections are elevated above the carriage. The swing-out linkage rotates the collapsed bed sections, between the storage and swung out positions, so that the longer dimension of the rectangle moves from a vertical orientation, in the storage position, to a horizontal orientation, in the swing-out position.

19 Claims, 6 Drawing Sheets

FIG. 1
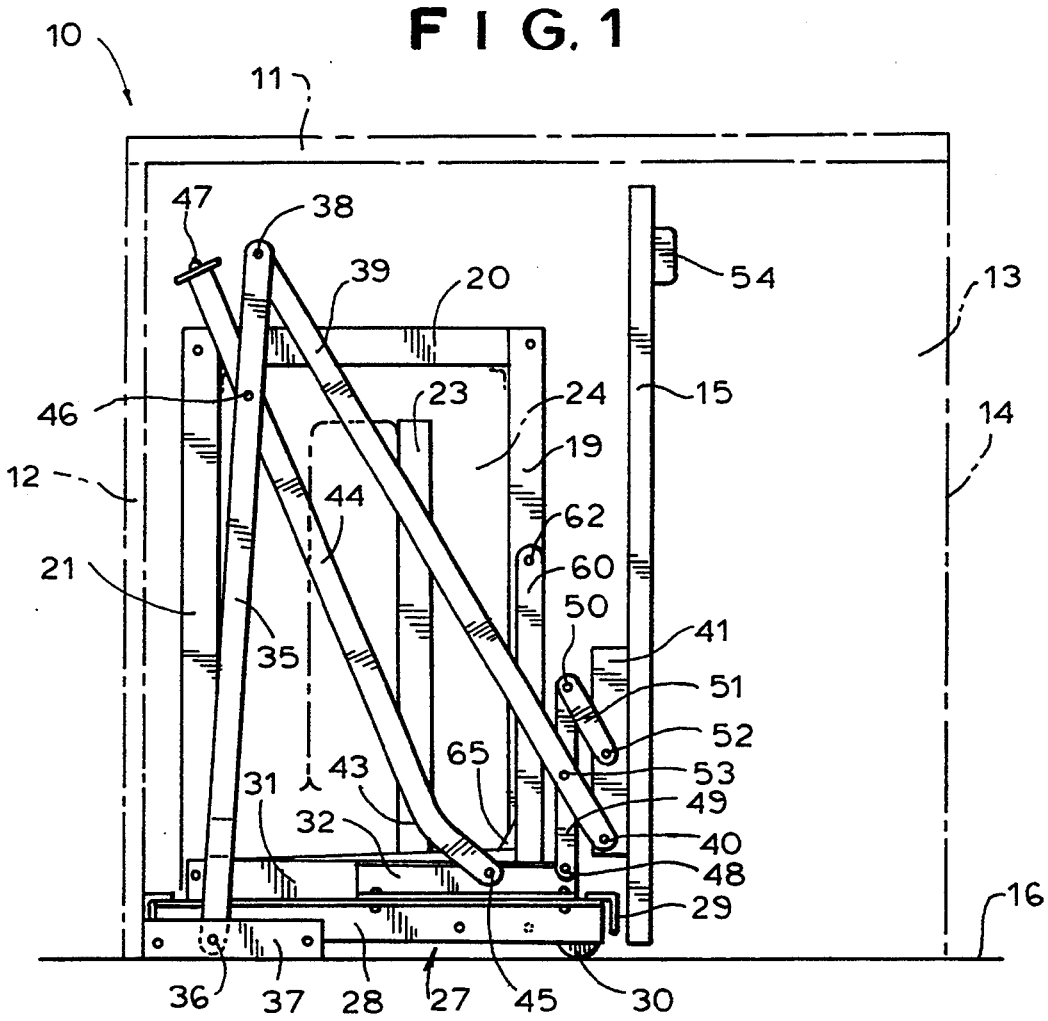
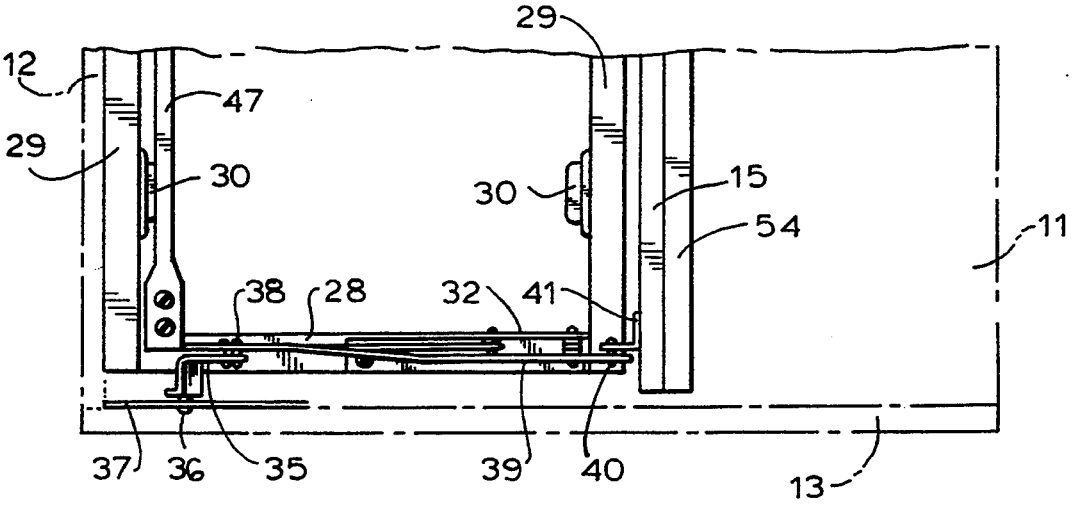
FIG. 8

FOLDING BED ASSEMBLY FOR USE WITHIN AN ARTICLE OF FURNITURE

This invention relates to a folding bed assembly, and has particular reference to such an assembly for use within an article of furniture, such as a desk or cabinet, having a fixed top wall.

The type of folding bed assembly with which the invention in concerned comprises bed sections that are pivoted to one another in succession and are foldable between a collapsed storage condition and extended bed condition. When such an assembly is folded into collapsed condition, it takes on a generally rectangular cross-sectional shape.

Folding bed assemblies of this type are well-known for use within sofa bodies. When used as part of a sofa-bed, the longer dimension of the rectangle is oriented horizontally when the folded assembly is within the sofa body. Moreover, the mechanism for folding and unfolding the bed assembly usually extends into the sofa body back to a height above the level of the top of the rectangle. To open the bed, the assembly is lifted upwardly out of the sofa body.

When attempting to combine a folding bed assembly with an article of furniture, such as a desk, a number of problems are presented which are not found when designing a sofa-bed assembly. For example, a desk has a fixed top wall, and hence the folded assembly cannot be lifted upwardly, to unfold it out of the piece of furniture, as is done with a sofa-bed. Moreover, since use of a desk requires room for the user's knees, orientating the longer dimension of the folded assembly rectangle horizontally deprives the desk of the required knee room.

It is an object of the present invention to overcome these and other problems by providing a folding bed assembly which, although secured to the article of furniture, can be moved outwardly beneath the fixed top of the piece of furniture and subsequently unfolded into extended bed condition.

It is another object of the invention to provide such an assembly oriented within a desk, or like article of furniture, so as to provide sufficient knee room for the user.

It is a further object of the invention to provide such a folding bed assembly which is completely hidden when collapsed and stored within the article of furniture, but which nevertheless can be readily moved out from the article of furniture and unfolded into extended bed condition.

Additional objects and features of the invention will be apparent from the following description in which reference is made to the accompanying drawings.

In the drawings:

FIG. 1 is a side view of a folding bed assembly in its fully collapsed, stored condition, the desk within which the assembly is stored being shown in dot-dash lines;

FIG. 8 is a fragmentary top view of part of the folding bed assembly in its collapsed and stored position.

Figure 7:
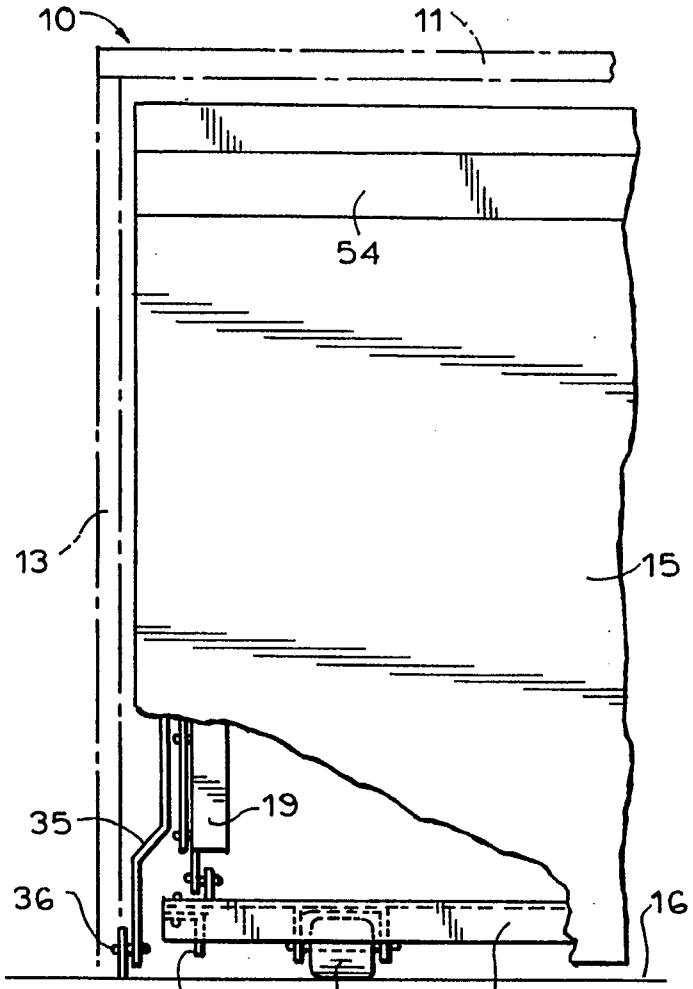
FIG. 7 is a fragmentary front view of a part of the folding bed assembly, in its stored condition, with part of the panel which hides the assembly being broken away.
Figure 2:
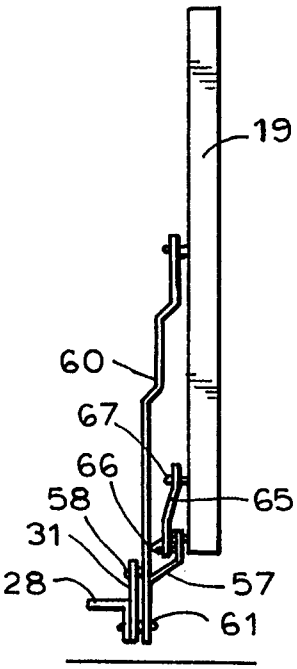
FIG. 2 is a fragmentary front view of one side of FIG. 1A.

The folding bed assembly chosen to illustrate the present invention is shown, and will be described, in cooperation with a desk. However, it is to be understood that the assembly has utility in connection with other types of furniture, particularly those having fixed top walls.

A desk 10 is schematically illustrated as having a top wall 11, a back wall 12, side walls 13, and an open front 14 providing access to a knee space beneath the front part of top wall 11. The rearward extremity of the knee space is defined by a solid panel 15, which preferably matches the material of which the remainder of the desk is fabricated. As is true with most conventional desks, top wall 11 is fixed to the back and side walls 12 and 13. However, as will be described more fully below, panel 15 is not fixed to the remainder of the desk. Desk 10 is shown supported on a floor 16.

Figure 1A:
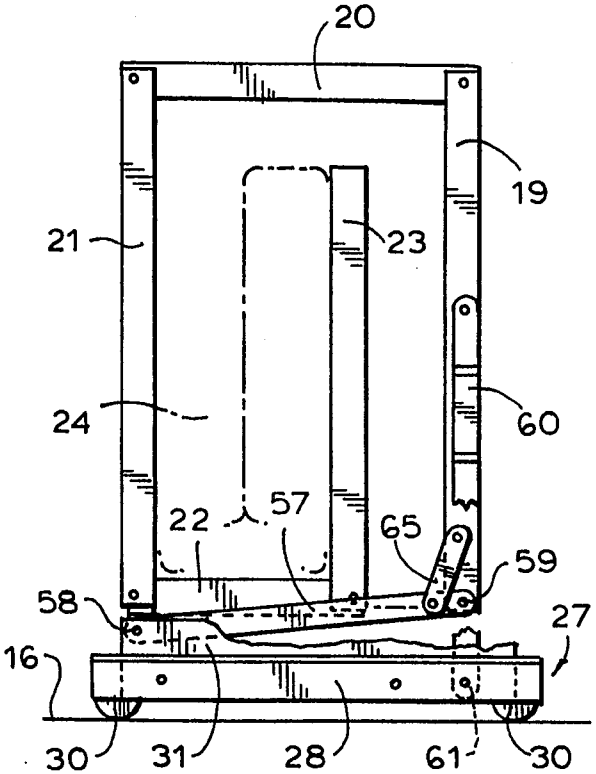
FIG. 1A is a view similar to FIG. 1 with certain parts of the assembly omitted, and others broken away, to reveal components which are otherwise hidden.

The folding bed assembly includes a series of bed sections pivoted to one another in succession, the bed sections being shown in FIGS. 1 and 1A folded into a collapsed condition and stored within the desk 10. In this condition, the bed sections assume a generally rectangular cross-sectional shape. The five bed sections, which are referred to by the orientations they assume when in the condition of FIG. 1, are, in succession, a front vertical section 19, an upper horizontal section 20, a rear vertical section 21, a lower horizontal section 22, and a middle vertical section 23. A mattress 24, shown in dot-dash lines, is folded upon itself within the confines of the collapsed bed sections. The bed sections and mattress are shown in extended bed condition in FIG. 6. It will be understood that the bed sections extend for substantially the full length of the desk, from one side 13 to the other, and that the anchorages of the assembly to the desk, and the linkages described below, are provided in duplicate, one at each side.

The folded bed sections are supported upon a carriage 27, which is essentially a rectangular frame formed of four angles, namely, two side angles 28 and front and back angles 29 (see FIGS. 1, 2, 7, and 8). Preferably, carriage 27 is provided with wheels 30 upon which carriage 27 can roll in a forward and rearward direction out of and into, respectively, the desk 10. Secured to each side 28 of carriage 27 is a side bracket 31 and a shorter carrier linkage bracket 32. Linkage, to be described, for controlling movement of the carriage is pivoted to carrier linkage bracket 32, and other linkage, also to be described, for elevating the folded bed sections away from the carriage after the latter is moved out of the desk, is pivotally secured to side bracket 31.

Figure 3:
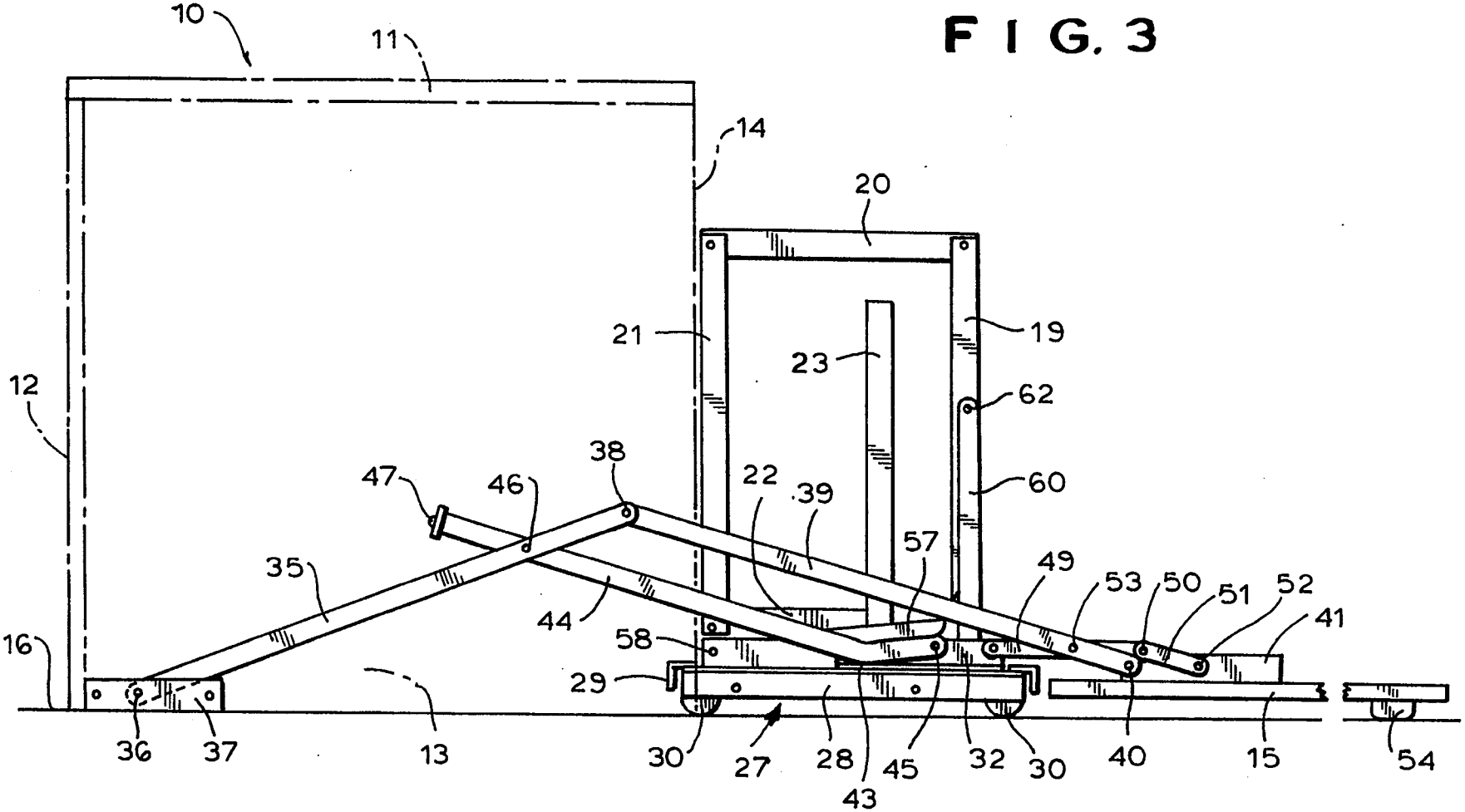
FIG. 3 is a view similar to FIG. 1 showing the folded bed sections pulled out of the desk.

The carriage linkage arrangement can best be seen, and understood, by comparing FIGS. 1 and 3. The arrangement includes a rear control arm 35 the rear end of which is connected by a pivot 36 to a mounting bracket 37 (see also FIG. 8) fixed to the inner surface of desk side wall 13. The opposite, or forward end, of rear control arm 35 is pivoted at 38 to the rear end of a panel operating link 39. The opposite, or forward end, of link 39 is pivoted at 40 to a bracket 41 fixed to the inner surface of panel 15.

The carriage linkage arrangement also includes a front control arm 44 the lower end of which is pivoted at 45 to carriage linkage bracket 32, and hence to carriage 27. Near its upper end, front control arm 44 is pivoted at 46 to a point on rear control arm 35 intermediate the ends of that control arm. At its upper end, front control arm 44 is connected by a stabilizer bar 47 to the upper end of the stabilizer bar 44 at the opposite end of the desk, i.e., stabilizer bar 47 extends for substantially the full length of desk 10. Front control arm 44 is not straight, but rather is bent near its lower end to define an abutment 43.

Pivoted at 48 to carrier linkage bracket 32 is a rear panel control link 49, the other end of which is pivoted at 50 to one end of a front panel control link 51. The other end of link 51 is pivoted at 52 to bracket 41 fixed to panel 15. An intermediate point of rear panel control link 49 is pivoted at 53 to a point on panel operating link 39 spaced a short distance from the pivot 40 end of link 39. It will be seen that panel 15 is supported solely by rear panel control link 49, front panel control link 51, and panel operating link 39. Panel 15 is unconnected to the desk by any other means. Thus, panel 15 is supported on, and moves with, carriage 27.

Fixed to the front face of panel 15, near its upper edge, is a handle, or pull, 54 which, in the present example, extends horizontally along the full length of panel 15 (see FIG. 7). By grasping and pulling on handle 54, the collapsed bed sections can be wheeled out of desk 10 upon carriage 27.

More specifically, when the folding bed assembly is in its collapsed and stored condition, as shown in FIG. 1, panel 15 completely hides the collapsed bed sections and the carriage, and appears to be a fixed part of desk 10. When it is desired to use the bed, handle 54 is grasped and pulled forwardly. This action causes panel 15 to simultaneously move forwardly out from beneath desk top 11 and also rotate in a clockwise direction, as viewed in FIGS. 1 and 3. This movement of front panel 15 causes panel operating link 39 to be pulled forwardly via the front and rear panel control links 51 and 49, as well as due to the pivot connection 40. Movement of link 39 forwardly causes front and rear control arms 44 and 35 to move forwardly, thereby pushing carriage 27 forwardly on its rollers 30, which roll upon floor 16. By the time panel 15 has been rotated from its initial vertical condition (FIG. 1) to its final horizontal position (FIG. 3), carriage 27 has been pushed completely out of desk 10 so that the collapsed bed sections 19–23 have cleared desk top wall 11. It will also be seen that in this condition, abutment 43 engages the horizontal arm of the angle-shaped carriage linkage bracket 32. The purpose of this engagement will be mentioned below.

When the folding bed assembly is in its fully collapsed and stored condition shown in FIG. 1, the longer dimension of the rectangular-shaped collapsed bed sections 19–23 is oriented vertically, so as to provide the maximum amount of knee room, beneath desk top wall 11, between the front opening 14 of the desk and panel 15. When the collapsed bed sections are pulled out of the desk, into the position shown in FIG. 3, the collapsed bed sections are still arranged so that the longer dimension of their collapsed rectangular shape is oriented vertically. Preparatory to unfolding the bed sections into the extended bed condition shown in FIG. 6, the collapsed bed sections are elevated above carriage 27 and rotated 90° from the storage position shown in FIG. 3 to a swing-out position shown in FIG. 5. To accomplish this movement, a swing-out linkage, interconnecting the carriage and the folded bed sections, is employed.

Figure 4:
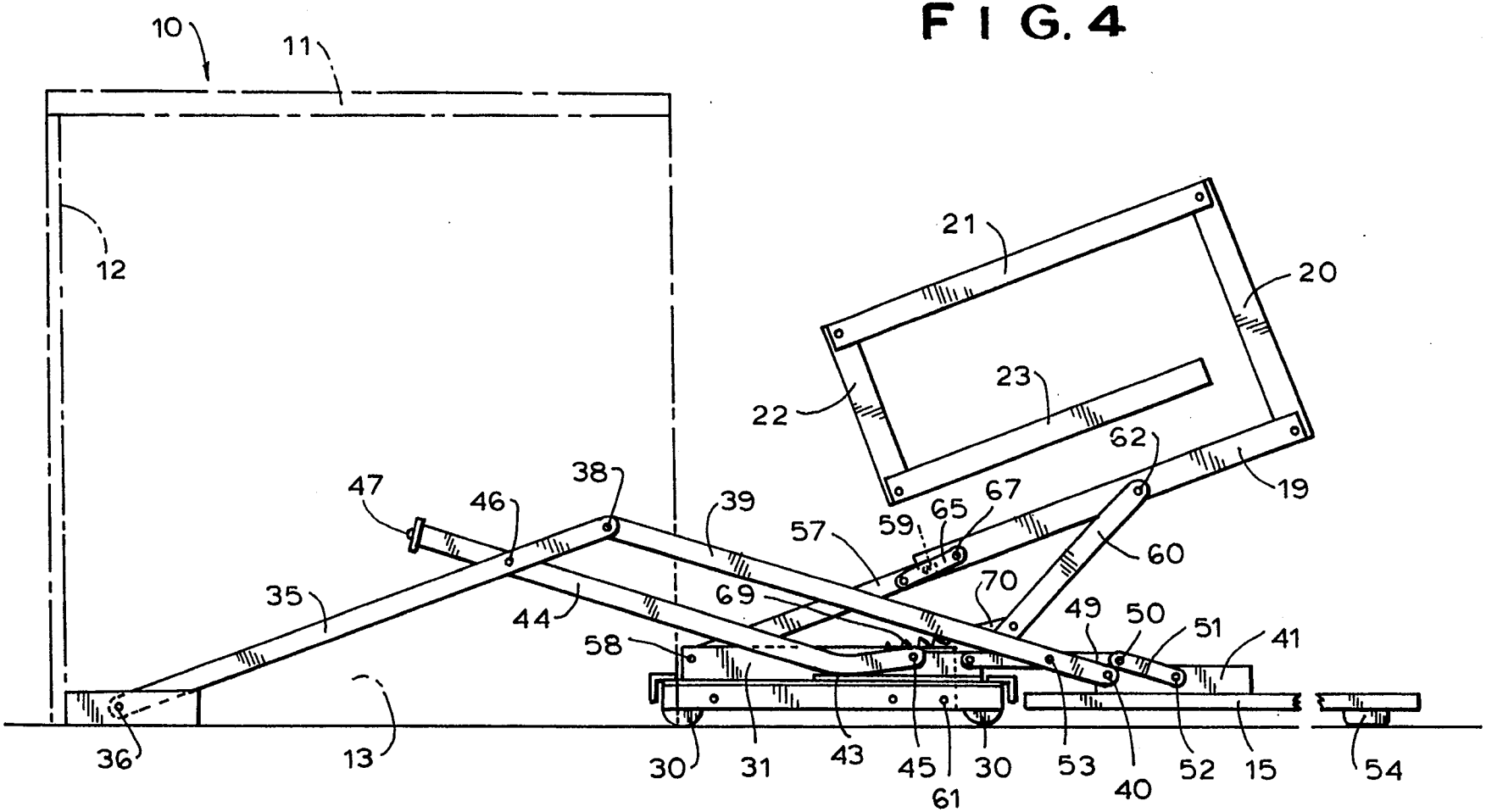
FIG. 4 is a view similar to FIG. 3 showing an intermediate position of the folded bed sections being rotated and lifted away from the carriage upon which the bed sections are supported.
Figure 5:
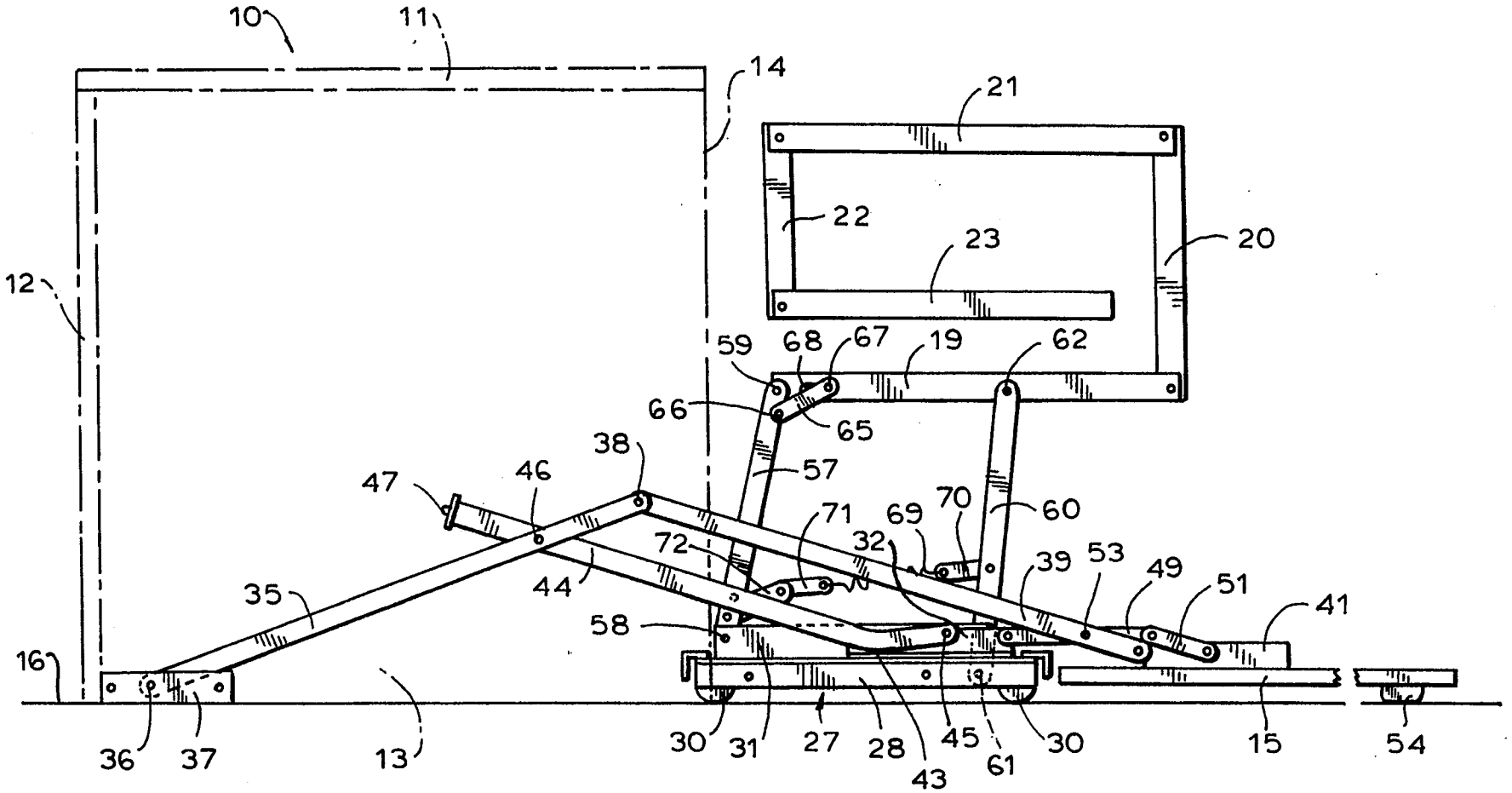
FIG. 5 is a view similar to FIG. 4 showing the folded bed sections fully rotated and elevated above the carriage.

The swing-out linkage, seen in FIGS. 3–5, includes a rear swing-out arm 57, one end of which is pivoted at 58 to side bracket 31 of carriage 27. The other end of arm 57 is pivoted at 59 to one end of front vertical bed section 19. The swing-out linkage also includes a front swing-out arm 60 having a lower end pivoted at 61 to side 28 of carriage 27 (see also FIGS. 1A and 2). The upper end of front swing-out arm 60 is pivoted at 62 to a point on front vertical bed section 19 intermediate the ends of that bed section.

One end of a stop link 65 (see also FIGS. 1A and 2) is pivoted at 66 to rear swing-out arm 57, and the other end carries a pin 67 slidable within a short slot 68 (FIG. 5) extending longitudinally along bed section 19. Stop link 65 limits the travel of the components so that the folded bed sections will not rotate clockwise past the swing-out position shown in FIG. 5, wherein the longer dimension of the rectangular shape of the folded sections is horizontal, and so that when the folded bed sections are being returned to the storage orientation shown in FIG. 3, they will not rotate in a counterclockwise direction past the position in which the longer dimension of the folded rectangular shape is vertical. The slideability of pin 67 in slot 68 permits relative movement between rear swing-out arm 57 and bed section 19 as the folded bed sections are moved between their FIG. 3 and FIG. 5 positions. A coiled tension spring 69 is connected at one end to a clip 70 fixed to front swing-out arm 60, the other end of spring 69 being connected to a clip 71 (FIG. 5) pivoted to a bracket 72 fixed to and projecting from rear swing-out arm 57.

When the collapsed bed sections are in the storage orientation shown in FIG. 3, front swing-out arm 60 is arranged generally vertically (FIGS. 1A and 3) and overlaps front vertical bed section 19. Rear swing-out arm 57 is oriented almost horizontally so that the two swing-out arms assume a generally L-shaped orientation (or as viewed in FIGS. 1A and 3 a reverse L-shaped orientation).

When it is desired to unfold the bed sections into an extended bed condition, the folded bed sections are grasped and rotated in a clockwise direction in FIG. 3. During this rotation, the parts will pass through an orientation illustrated in FIG. 4. In this orientation, rear swing-out arm 57 has risen, i.e., has swung counterclockwise about pivot 58, and is aligned with front vertical bed section 19, the still folded bed sections having rotated approximately 45°. The alignment of arm 57 and bed section 19 creates a "dead-center" condition, and as soon as the parts move past this dead-center condition, by continued clockwise rotation of the folded bed sections, spring 69 assists in continued clockwise rotation of the folded bed sections to bring the parts into the swing-out condition shown in FIG. 5. The still-folded bed sections have thus been elevated above carriage 27, to bring front vertical section 19 to bed height above floor 16, and the still-folded bed sections have been rotated 90°. In the condition of the folded bed sections shown in FIG. 5, swing-out arms 57 and 60 have moved from their L-shaped orientation shown in FIGS. 1A and 3, to a position in which these arms 57 and 60, together with bed section 19 and carriage side 28 define generally a parallelogram.

Figure 6:
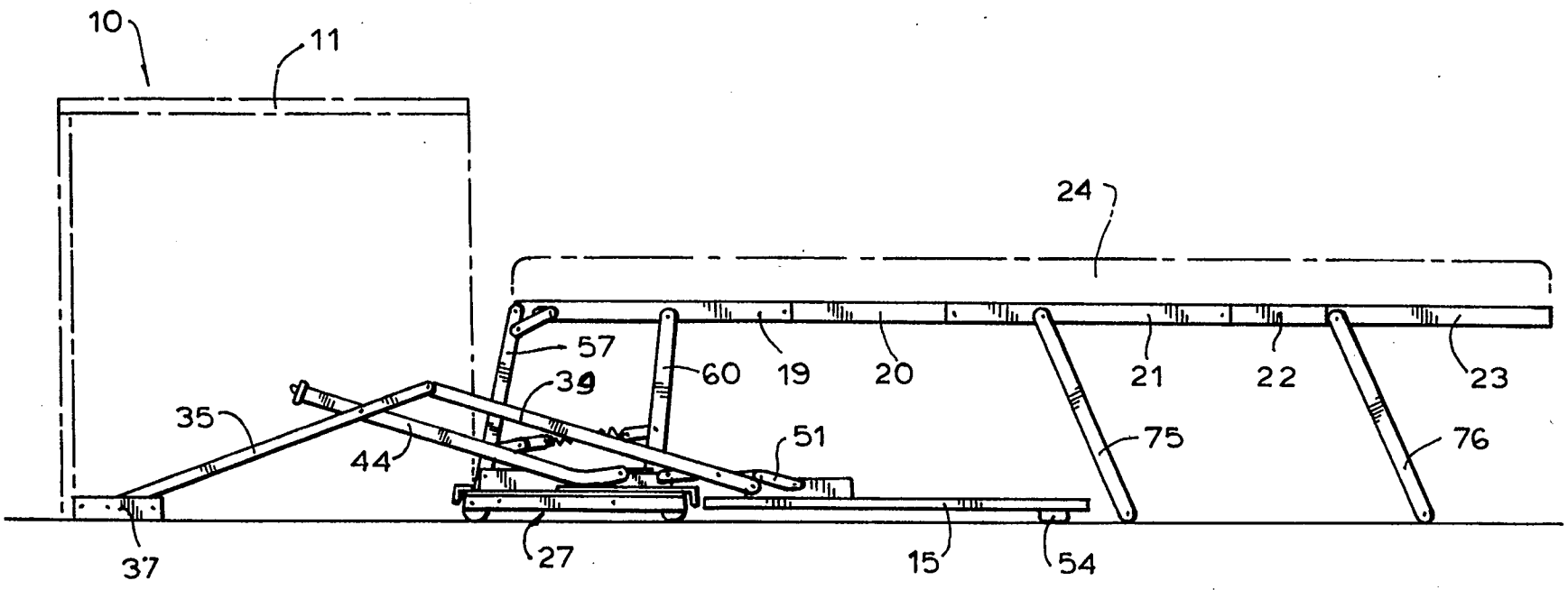
FIG. 6 is a view similar to FIG. 5 showing the bed sections unfolded into extended bed condition.

The bed sections can now be unfolded into extended bed condition. The usual linkages for controlling the unfolding of the bed sections 19–23 have not been shown, and will not be described, since they are conventional. FIG. 6 does illustrate legs 75 and 76 which support the bed sections on floor 16. When the bed sections are unfolded into extended bed condition, as shown in FIG. 6. abutment 43 engaging carriage 27, or more correctly the horizontal arm of bracket 32, prevents the rear wheels 30 of carriage 27 from lifting off the floor. Without the engagement of abutment 43 with carriage 27, the weight of a person on mattress 24 might cause the carriage to rotate about its front wheels 30 whereby its rear wheels would be lifted off the floor.

When it is desired to fold and store the bed, the bed sections 19–23 are folded from the extended condition shown in FIG. 6 to the collapsed condition shown in FIG. 5. Then, the folded bed sections are rotated, as a unit, in a counterclockwise direction through the position shown in FIG. 4. As soon as continued counterclockwise rotation causes rear swing-out arm 57 and bed section 19 to move past their dead-center position, spring 69 aids in continued counterclockwise rotation to bring the collapsed bed sections into the storage orientation shown in FIG. 3. At this point, panel 15 is lifted, using handle 54, and rotated in a counterclockwise direction in FIG. 3. This movement causes panel operating link 39 to pivot rear and front control arms 35 and 44 so as to pull carriage 27 into the desk under fixed top wall 11. This movement continues until panel 15 reaches its vertical orientation and the parts once again reach the fully stored condition shown in FIG. 1.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A folding bed assembly for use within an article of furniture having a fixed top wall, comprising:

a series of bed sections pivoted to one another in succession, the sections being foldable into a generally rectangular collapsed condition in which the longer dimension of the rectangle is oriented vertically when the folded sections are within the article of furniture, a carriage upon which the series of bed sections is mounted, a vertical panel for hiding the bed assembly when the assembly is within the article of furniture, and means responsive to pivoting of the panel from its vertical orientation to a horizontal orientation for moving the carriage and bed sections out of the article of furniture, the movement of the carriage and bed sections out from beneath the fixed top wall of the article of furniture being translational in nature without any component of pivotal movement.

2. A folding bed assembly as defined in claim 1 including a handle near the upper edge of the panel for facilitating pivoting on the panel.

3. A folding bed assembly as defined in claim 1 wherein the responsive means includes means for mounting the panel on the carriage.

4. A folding bed assembly as defined in claim 1 wherein the responsive means includes a carriage linkage arrangement for pivotally interconnecting the article of furniture, the carriage, and the panel.

5. A folding bed assembly as defined in claim 4 wherein the carriage linkage arrangement supports the panel, and the panel is otherwise unconnected to the article of furniture.

6. A folding bed assembly as defined in claim 4 wherein the carriage is provided with front and rear wheels which rest upon the floor, the carriage linkage arrangement includes a front control arm pivoted to the carriage, the front control arm being formed with an abutment spaced from the point at which the front control arm is pivoted to the carriage, and the abutment engaging the carriage when the carriage reaches the full extent of its travel out of the article of furniture, the engagement between the abutment and the carriage preventing the rear wheels of the carriage from lifting off the floor when the bed sections are unfolded into an extended bed condition.

7. A folding bed assembly as defined in claim 1 including a swing-out linkage pivotally supporting the collapsed bed sections on the carriage, the swing-out linkage constraining the collapsed bed sections to move between a storage position, in which the collapsed bed sections are close to the carriage, and a swing-out position in which the collapsed bed sections are elevated above the carriage.

8. A folding bed assembly for use within an article of furniture having a fixed top wall, comprising:

a series of bed sections pivoted to one another in succession, the sections being foldable into a generally rectangular collapsed condition in which the longer dimension of the rectangle is oriented vertically when the folded sections are within the article of furniture, a carriage upon which the series of bed sections is mounted, a vertical panel for hiding the bed assembly when the assembly is within the article of furniture, means responsive to pivoting of the panel from its vertical orientation to a horizontal orientation for moving the carriage and bed sections out of the article of furniture, and a swing-out linkage pivotally supporting the collapsed bed sections on the carriage, the swing-out linkage constraining the collapsed bed sections to move between a storage position, in which the collapsed bed sections are close to the carriage, and a swing-out position in which the collapsed bed sections are elevated above the carriage, the swing-out linkage including front and rear swing-out arms pivoted to the carriage at two spaced-apart points, the swing-out arms also being pivoted to one of the bed sections at two spaced apart points, said swing-out arms, carriage, and bed section defining generally a parallelogram when the collapsed bed sections are in their swing-out position, and said swing-out arms, carriage, and bed section assuming a generally L-shaped orientation when the collapsed bed sections are in their storage position.

9. A folding bed assembly as defined in claim 8 including a stop link pivotally connected between the rear swing-out arm and said bed section, the stop link serving to limit the movement of the swing-out linkage in each of its extreme positions, i.e., when the collapsed bed sections are in their swing-out position and in their storage position.

10. A folding bed assembly as defined in claim 9 wherein the pivot connection between the stop link and one of the rear swing-out arm and said bed section is formed by a pin slidable in a slot, the pin and slot arrangement permitting the pivot between the rear swing-out arm and said bed section to articulate during movement of the swing-out linkage between its extreme positions.

11. A folding bed assembly as defined in claim 8 wherein as the swing-out linkage moves from one of its extreme positions to the other, the rear swing-out arm and said bed section pass through a "dead-center" orientation in which they are aligned, and including spring means for assisting movement of the swing-out linkage from its condition in which the rear swing-out arm and said bed section are aligned to each of its extreme positions.

12. A folding bed assembly as defined in claim 11 wherein the spring means is a tension spring connected between the front and rear swing-out arms.

13. A folding bed assembly for use within an article of furniture having a fixed top wall, comprising:

a series of bed sections pivoted to one another in succession, the sections being foldable into a generally rectangular collapsed condition in which the longer dimension of the rectangle is oriented vertically when the folded sections are within the article of furniture, a carriage upon which the series of bed sections is mounted, and a swing-out linkage pivotally supporting the collapsed bed sections on the carriage, the swing-out linkage constraining the collapsed bed sections to move between a storage position, in which the collapsed bed sections are close to the carriage, and a swing-out position in which the collapsed bed sections are elevated above the carriage, the swing-out linkage including front and rear swing-out arms pivoted to the carriage at two spaced-apart points, the swing-out arms also being pivoted to one of the bed sections at two spaced apart points, said swing-out arms, carriage, and bed section defining generally a parallelogram when the collapsed bed sections are in their swing-out position, and said swing-out arms, carriage, and bed section assuming a generally L-shaped orientation when the collapsed bed sections are in their storage position.

14. A folding bed assembly as defined in claim 13 including a stop link pivotally connected between the rear swing-out arm and said bed section, the stop link serving to limit the movement of the swing-out linkage in each of its extreme positions, i.e., when the collapsed bed sections are in their swing-out position and in their storage position.

15. A folding bed assembly as defined in claim 14 wherein the pivot connection between the stop link and one of the rear swing-out arm and said bed section is formed by a pin slidable in a slot, the pin and slot arrangement permitting the pivot between the rear swing-out arm and said bed section to articulate during movement of the swing-out linkage between its extreme positions.

16. A folding bed assembly as defined in claim 13 wherein as the swing-out linkage moves from one of its extreme positions to the other, the rear swing-out arm and said bed section pass through a "dead-center" orientation in which they are aligned, and including spring means for assisting movement of the swing-out linkage from its condition in which the rear swing-out arm and said bed section are aligned to each of its extreme positions.

17. A folding bed assembly for use within an article of furniture having a fixed top wall, comprising:

a series of bed sections pivoted to one another in succession, the sections being foldable into a generally rectangular collapsed condition in which the longer dimension of the rectangle is oriented vertically when the folded sections are within the article of furniture, a carriage upon which the series of bed sections is mounted, the carriage being provided with wheels which rest upon, an roll along, the floor upon which the article of furniture is supported, a vertical panel for hiding the bed assembly when the assembly is within the article of furniture, and means responsive to pivoting of the panel from its vertical orientation to a horizontal orientation for moving the carriage and bed sections out of the article of furniture.

18. A folding bed assembly for use within an article of furniture having a fixed top wall, comprising:

a series of bed sections pivoted to one another in succession, the sections being foldable into a generally rectangular collapsed condition in which the longer dimension of the rectangle is oriented vertically when the folded sections are within the article of furniture, a carriage upon which the series of bed sections is mounted, a vertical panel for hiding the bed assembly when the assembly is within the article of furniture, means responsive to pivoting of the panel from its vertical orientation to a horizontal orientation for moving the carriage and bed sections out of the article of furniture, and a swing-out linkage pivotally supporting the collapsed bed sections on the carriage, the swing-out linkage constraining the collapsed bed sections to move between a storage position, in which the collapsed bed sections are close to the carriage, and a swing-out position in which the collapsed bed sections are elevated above the carriage, the swing-out linkage rotating the collapsed bed sections, between the storage and swing-out positions, so that the longer dimension of the rectangle moves from a vertical orientation, in the storage position, to a horizontal orientation, in the swing-out position.

19. A folding bed assembly for use within an article of furniture having a fixed top wall, comprising:

a series of bed sections pivoted to one another in succession, the sections being foldable into a generally rectangular collapsed condition in which the longer dimension of the rectangle is oriented vertically when the folded sections are within the article of furniture, a carriage upon which the series of bed sections is mounted, and a swing-out linkage pivotally supporting the collapsed bed sections on the carriage, the swing-out linkage constraining the collapsed bed sections to move between a storage position, in which the collapsed bed sections are close to the carriage, and a swing-out position in which the collapsed bed sections are elevated above the carriage, the swing-out linkage rotating the collapsed bed sections, between the storage and swing-out positions, so that the longer dimension of the rectangle moves from a vertical orientation, in the storage position, to a horizontal orientation, in the swing-out position.

* * * * *